US007271340B2

(12) United States Patent
Buck et al.

(10) Patent No.: US 7,271,340 B2
(45) **Date of Patent: *Sep. 18, 2007**

(54) FLEXIBLE INTERCONNECT CABLE WITH INSULATED SHIELD AND METHOD OF MANUFACTURING

(75) Inventors: Arthur Glen Buck, Sherwood, OR (US); Dana Anne Daugherty, Vancouver, WA (US); Thanh Hoang Tran, Portland, OR (US); Kristin Thu Huong Ngo, Portland, OR (US)

(73) Assignee: Precision Interconnect, Inc., Wilsonville, OR (US)

( * ) Notice: Subject to any disclaimer, the term of this patent is extended or adjusted under 35 U.S.C. 154(b) by 0 days.

This patent is subject to a terminal disclaimer.

(21) Appl. No.: 11/030,409

(22) Filed: Jan. 6, 2005

(65) Prior Publication Data

US 2006/0144613 A1 Jul. 6, 2006

(51) Int. Cl.
*H01R 9/05* (2006.01)

(52) U.S. Cl. ..... 174/75 C; 174/78; 174/113 R

(58) Field of Classification Search ..... 174/102 R, 174/107, 75 C, 78, 113 R
See application file for complete search history.

(56) References Cited

U.S. PATENT DOCUMENTS

| | | | | |
|---|---|---|---|---|
| 3,333,049 | A * | 7/1967 | Humphrey et al. | 174/102 SC |
| 3,639,356 | A * | 2/1972 | Bradshaw | 528/353 |
| 4,761,519 | A * | 8/1988 | Olson et al. | 174/107 |
| 5,012,125 | A * | 4/1991 | Conway | 307/149 |
| 6,403,503 | B1 * | 6/2002 | Weinberg | 442/149 |
| 6,580,034 | B2 | 6/2003 | Daane et al. | |
| 6,672,894 | B2 | 1/2004 | Sprunger | |
| 6,734,362 | B2 * | 5/2004 | Buck et al. | 174/113 R |
| 2002/0092668 | A1 * | 7/2002 | Groegl et al. | 174/105 R |

FOREIGN PATENT DOCUMENTS

GB 2084811 * 4/1982

* cited by examiner

*Primary Examiner*—Chau N. Nguyen

(57) ABSTRACT

A cable assembly having a plurality of wires, each having a first end and an opposed second end. A sheath including an shield encompasses all the wires. The shield is a braid formed of a plurality of braid wires, and each of the braid wires has an insulating coating. The wires of the braid may be gathered at an end into a pigtail. The insulation is removed from the wires at the pig tail. The insulation may be removed by dipping the pigtail in a high temperature solder bath.

19 Claims, 6 Drawing Sheets

FLEXIBLE INTERCONNECT CABLE WITH INSULATED SHIELD AND METHOD OF MANUFACTURING

FIELD OF THE INVENTION

This invention relates to multiple wire cables, and more particularly to small gauge coaxial wiring.

BACKGROUND AND SUMMARY OF THE INVENTION

Certain demanding applications require miniaturized multi-wire cable assemblies. To avoid undesirably bulky cables when substantial numbers of conductors are required, very fine conductors are used. To limit electrical noise and interference, coaxial wires having shielding are used for the conductors. In other application, twisted pairs, parallel pairs, unshielded insulated single wires, and other configurations may be employed. A bundle of such wires is surrounded by a conductive shield formed of braided small wires to prevent radio interference from being emitted or received by the cable components. An outer protective sheath covers the shield.

Some applications requiring many different conductors prefer that a cable be very flexible, supple, or "floppy." This has been achieved by providing a shielding braid that loosely receives the wires, as disclosed in U.S. Pat. No. 6,734,362, which is incorporated herein by reference. Because the braid is formed of bare metal wires, it may have an abrasive effect on the bundle of signal wires in certain applications where flexing and external stresses are extreme. Such abrasion may generate open failures in the individual shield wires of coaxial wire components, generating signal noise during operation due to shorting between the now-open wire shield and the outer braided cable shield. Other failure modes include abrasion of wire insulation, which may expose the signal conductors to shorting with the braid or to each other. This is critical because the compact size desired for many such cables requires a very thin insulation layer (in the range of 0.001 to 0.010 inches) on each wire.

Because the stresses and wear are generally concentrated at the ends of a cable near strain relief elements such as disclosed in U.S. Pat. No. 6,672,894 (incorporated herein by reference), measures have been taken to protect the cable bundle at such stress points. As disclosed in U.S. Pat. No. 6,580,034 (incorporated herein by reference), the cable bundle may be wrapped at its ends near the stress points with a low-friction Teflon tape. While effective, this reduces the benefits of a loose shield, which provides the desired supple effect. Tape-wrapped wires are captured in a bundle that does not readily flatten to permit easy bending to small radiuses. This is not problematic for many applications, because the flexibility remains excellent over nearly the entire length of the cable. However, in some applications, flexibility near the ends is a valued characteristic that is preferably not sacrificed. Moreover, for applications in which there is a risk of damage due to intense stresses causing wear anywhere along the entire cable length, wrapping the entire cable bundle with tape to prevent such wear unacceptably sacrifices the flexibility desired for many applications.

The present invention overcomes the limitations of the prior art by providing a cable assembly having a plurality of wires, each having a first end and an opposed second end. A sheath including an shield encompasses all the wires. The shield is a braid formed of a plurality of braid wires, and each of the braid wires has an insulating coating. The wires of the braid may be gathered at an end into a pigtail. The insulation is removed from the wires at the pig tail. The insulation may be removed by dipping the pigtail in a high temperature solder bath.

DETAILED DESCRIPTION OF A PREFERRED EMBODIMENT

Figure 1:
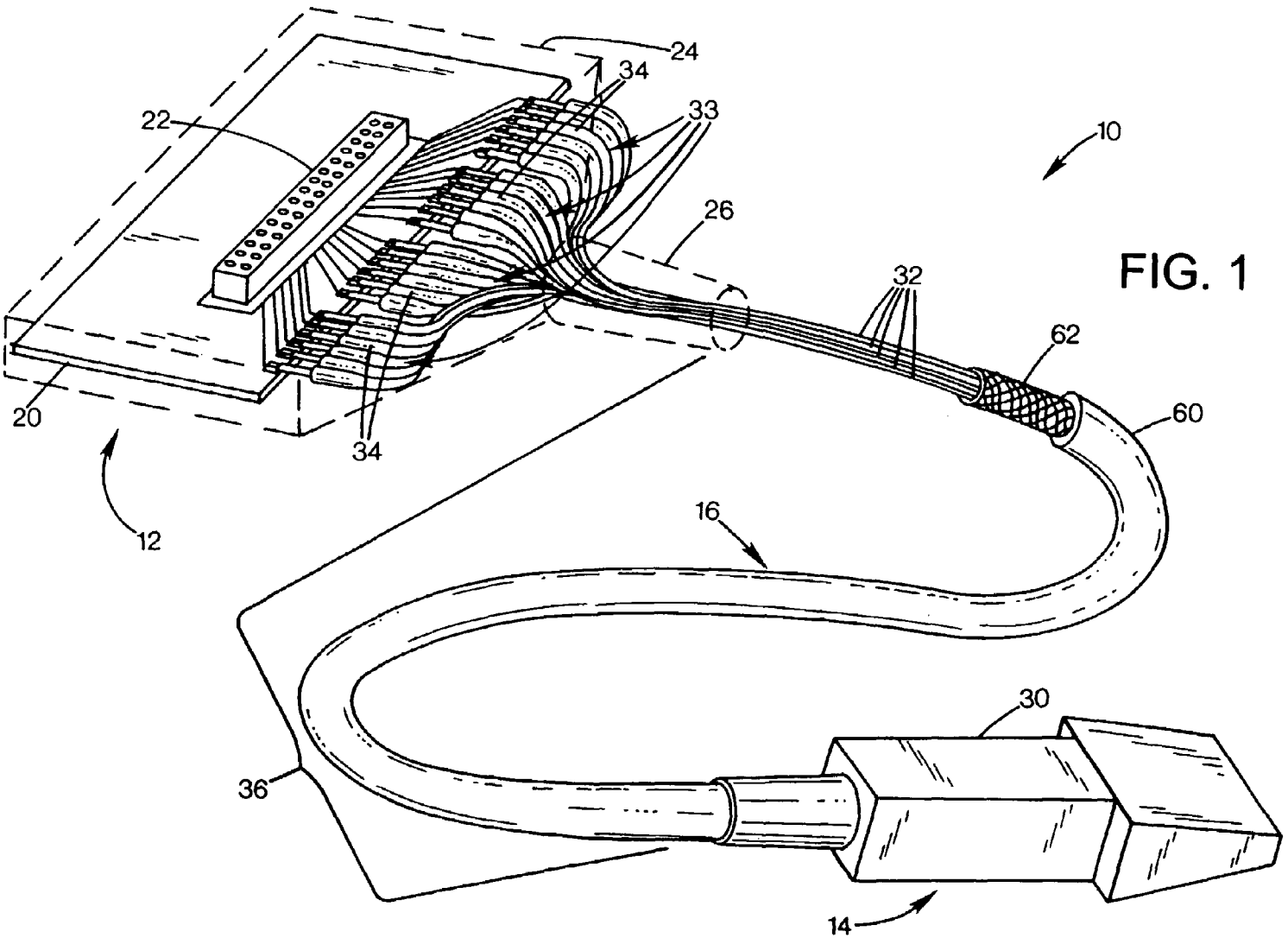
FIG. 1 is a perspective view of a cable assembly according to a preferred embodiment of the invention.

FIG. 1 shows a cable assembly 10 having a connector end 12, a transducer end 14, and a connecting flexible cable 16. The connector end and transducer ends are shown as examples of components that can be connected to the cable 16. In this example, the connector end includes a circuit board 20 with a connector 22 for connection to an electronic instrument such as an ultrasound imaging machine. The connector end includes a connector housing 24, and strain relief 26 that surrounds the end of the cable. On the opposite end, an ultrasound transducer 30 is connected to the cable.

Figure 2:
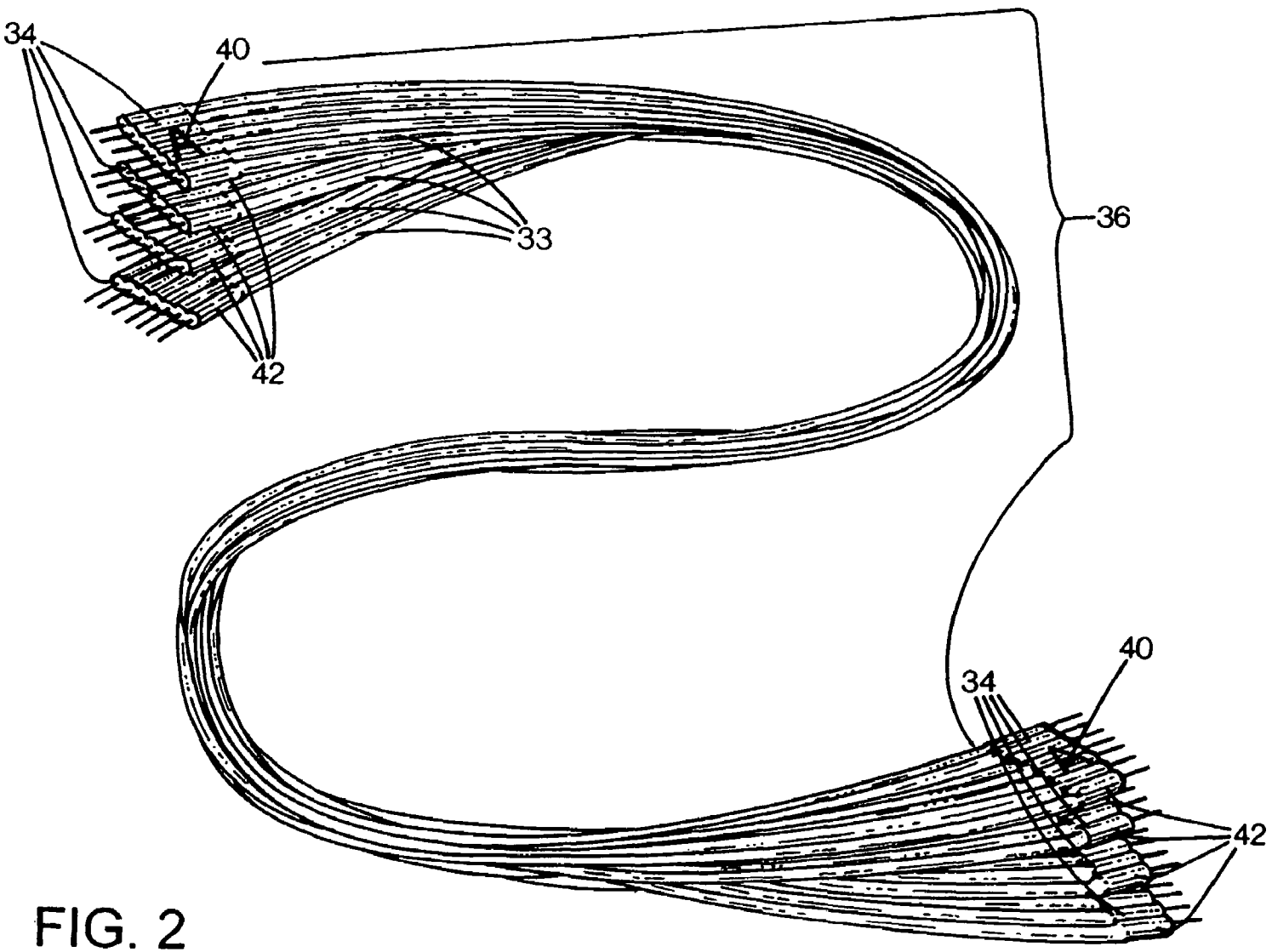
FIG. 2 is a perspective view of wiring components according to the embodiment of FIG. 1.

The cable 16 includes a multitude of fine coaxially shielded wires 32. As also shown in FIG. 2, the wires are arranged into groups 33, with each group having a ribbonized ribbon portion 34 at each end, and an elongated loose portion 36 between the ribbon portions and extending almost the entire length of the cable. Each ribbon portion includes a single layer of wires arranged side-by-side, adhered to each other, and trimmed to expose a shielding layer and center conductor for each wire. In the loose portion, the wires are unconnected to each other except at their ends.

The shielding and conductor of each wire are connected to the circuit board, or to any electronic component or connector by any conventional means, as dictated by the needs of the application for which the cable is used. The loose portions 36 of the wires extend the entire length of the cable between the strain reliefs, through the strain reliefs, and into the housing where the ribbon portions are laid out and connected.

The ribbon portions 34 are each marked with unique indicia to enable assemblers to correlate the opposite ribbon portions of a given group, and to correlate the ends of particular wires in each group. A group identifier 40 is imprinted on the ribbon portion, and a first wire identifier 42 on each ribbon portion assures that the first wire in the sequence of each ribbon is identified on each end. It is important that each group have a one-to-one correspondence in the sequence of wires in each ribbon portion. Consequently, an assembler can identify the nth wire from the identified first end wire of a given group "A" as corresponding to the nth wire at the opposite end ribbon portion, without the need for trial-and-error continuity testing to find the proper wire. This correspondence is ensured, even if the loose intermediate portions 36 of each group are allowed to move with respect to each other, or with the intermediate portions of other groups in the cable.

Figure 3:
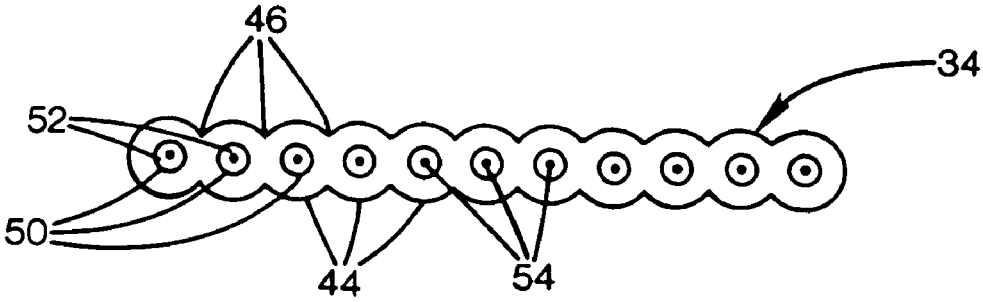
FIG. 3 is an enlarged sectional view of an end portion of a wiring component according to the embodiment of FIG. 1.

FIG. 3 shows a cross section of a representative end portion, with the wires connected together at their outer sheathing layers 44 at weld joints 46, while the conductive shielding 50 of each of the wires remains electrically isolated from the others, and the inner dielectric 52 and central conductors 54 remain intact and isolated. In alternative embodiments, the ribbon portions may be secured by the use of adhesive between abutting sheathing layers 44, by adhesion of each sheathing layer to a common strip or sheet, or by a mechanical clip.

Figure 4:
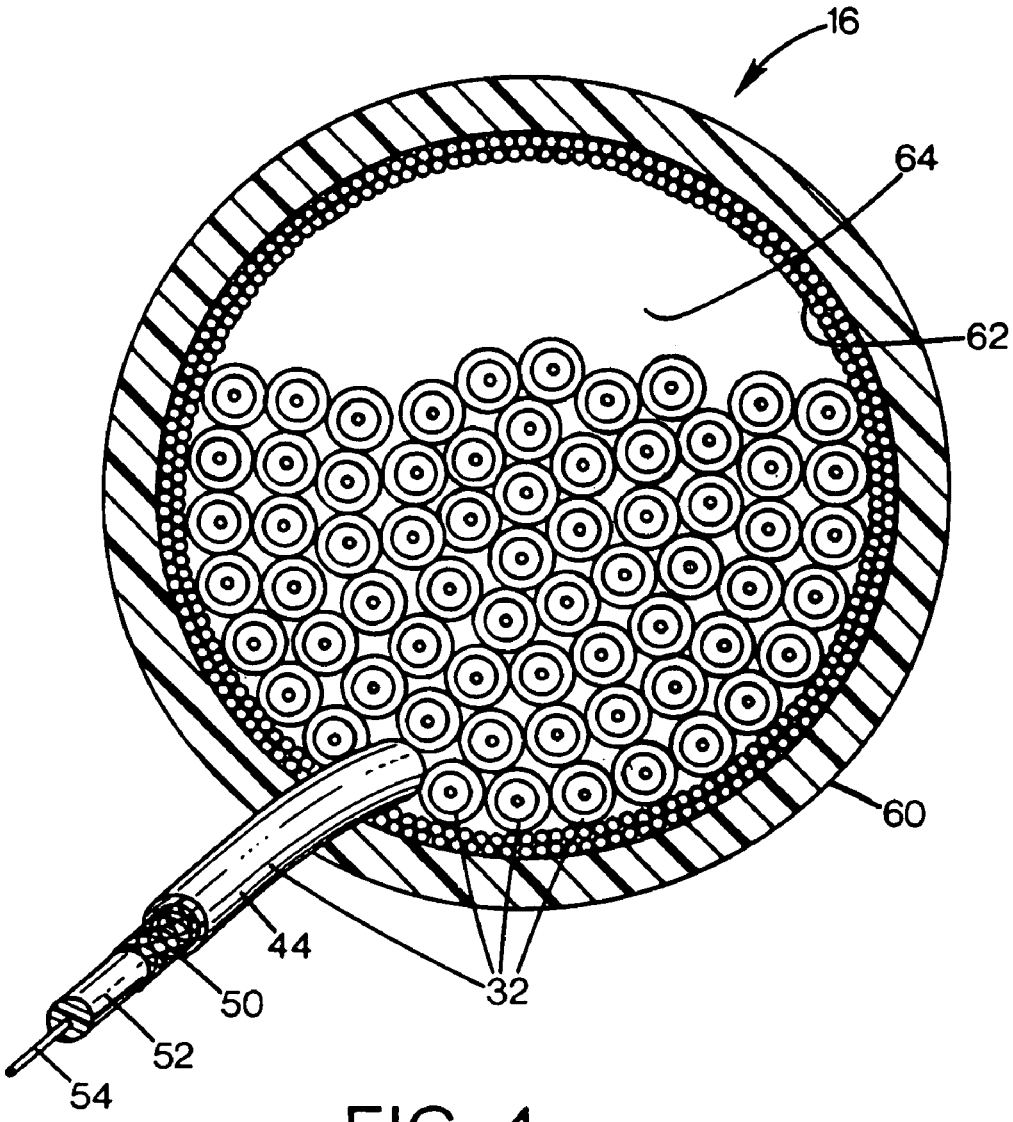
FIG. 4 is an enlarged sectional view of the cable assembly according to the embodiment of FIG. 1.
Figure 5:
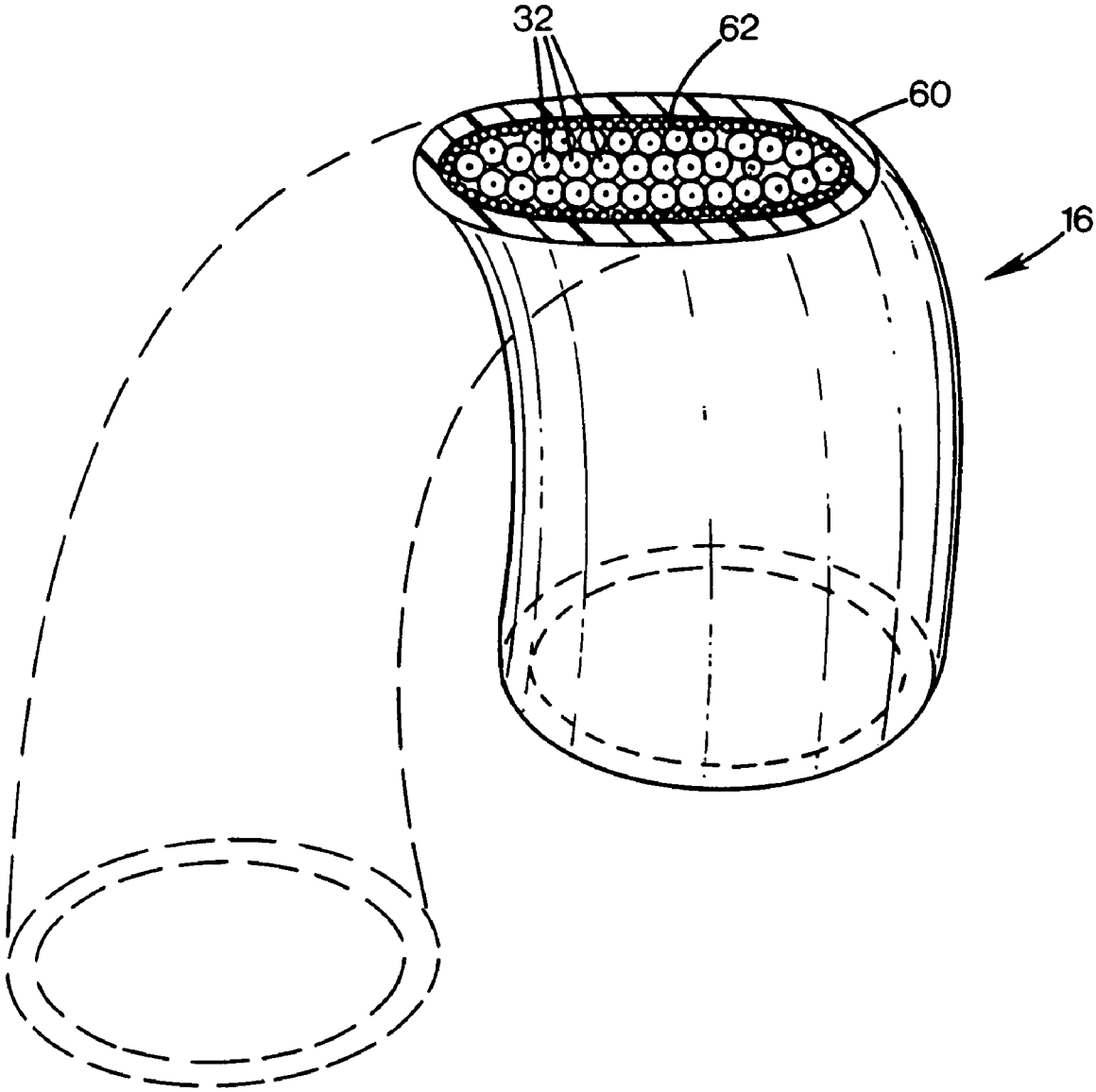
FIG. 5 is an enlarged sectional view of the cable assembly in a flexed condition according to the embodiment of FIG. 1.

FIG. 4 shows the cable cross section throughout most of the length of the cable, away from the ribbon portions, reflecting the intermediate portion. The wires are loosely contained within a flexible cylindrical cable sheath 60. As also shown in FIG. 1, a conductive braided shield 62 surrounds all the wires, and resides at the interior surface of the sheath to define a bore 64. Returning to FIG. 4, the bore diameter is selected to be somewhat larger than required to closely accommodate all the wires. This provides the ability for the cable to flex with minimal resistance to a tight bend, as shown in FIG. 5, as the wires are free to slide to a flattened configuration in which the bore cross section is reduced from the circular cross section it has when held straight, as in FIG. 4.

In the preferred embodiment, there are 8 groups of 16 wires each, although either of these numbers may vary substantially, and some embodiments may use all the wires in a single group. The wires preferably have an exterior diameter of 0.016 inch, although this and other dimensions may range to any size, depending on the application. The cable has an overall exterior diameter of the jacket portion 60 of 0.330 inch and the sheath has a bore diameter of 0.270 inch. As the loose wires tend to pack to a cross-sectional area only slightly greater than the sum of their areas, there is significant extra space in the bore in normal conditions. This allows the wires to slide about each other for flexibility, and minimizes wire-to-wire surface friction that would occur if the wires were tightly wrapped together, such as by conventional practices in which a wire shield is wrapped about a wire bundle. In the preferred embodiment, a bend radius of 0.75 inch, or about 2 times the cable diameter, is provided with minimal bending force, such as if the cable is folded between two fingers and allowed to bend to a natural radius. Essentially, the bend radius, and the supple lack of resistance to bending is limited by little more than the total bending resistance of each of the components. Because each wire is so thin, and has minimal resistance to bending at the radiuses on the scale of the cable diameter, the sum of the wire's resistances adds little to the bending resistance of the sheath and shield, which thus establish the total bending resistance.

The shield wires 62 are 40 gauge (0.0031 inch) copper wire 66 with a 0.004 inch thick coating 68 of insulating material, although other wire gauge may be employed for different applications. In the preferred embodiment, Solvar™ material from REA of Fort Wayne, Ind. is preferred for the insulation. In alternative embodiments, the shield braid wire insulation may be any alternative dielectric material having a robust resistance to abrasion and a low friction surface such as thermoplastic or thermoset resin. In the preferred embodiment, the exposed surface of the insulation is treated with or includes a material for lubricity, to aid in the manufacturing process, and to further avoid internal friction or abrasion in the finished cable. For lubricity, the entire insulation may be of a common lubricious material, or an outer layer or coating of such material may be provided.

METHOD OF MANUFACTURING

Figure 6:
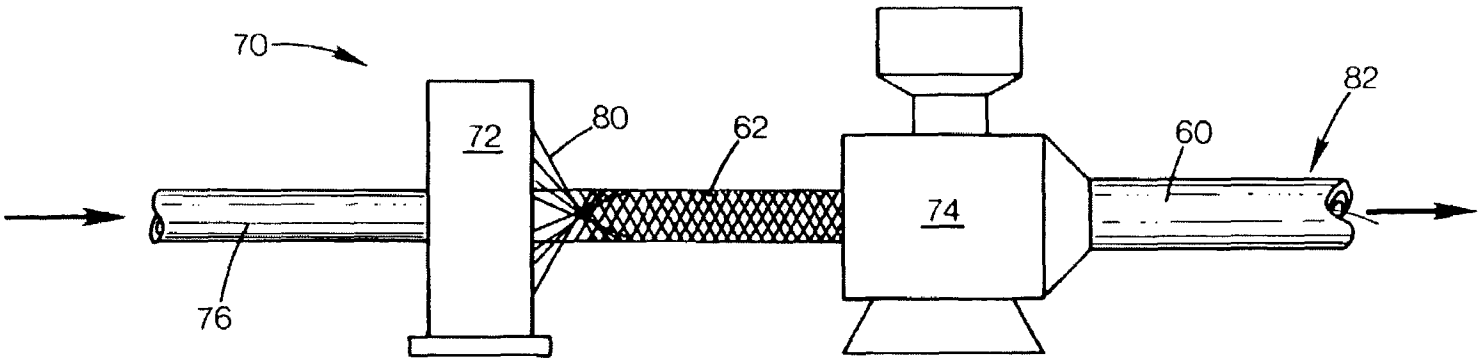
FIG. 6 is a simplified side view of a first process in a preferred method of manufacturing a cable assembly.
Figure 7A:
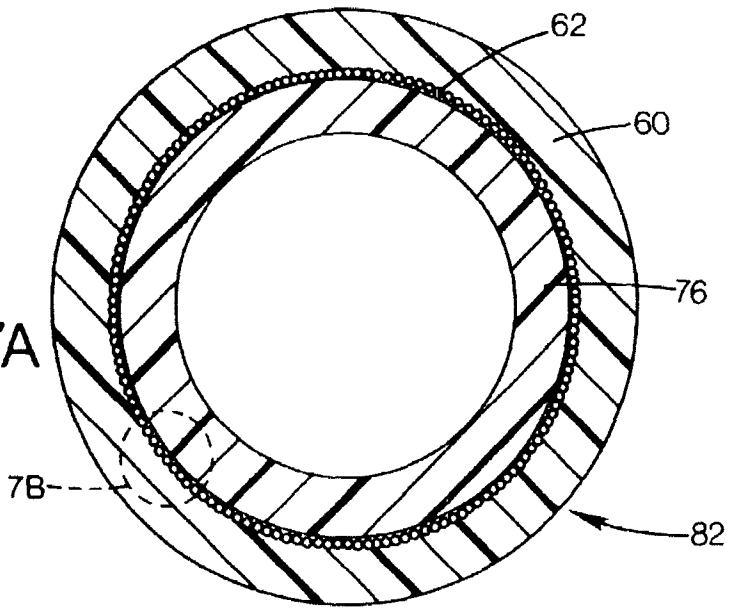
FIGS. 7A and 7B are a cross sectional views of a cable sheath component of the preferred embodiment of the invention.
Figure 7B:
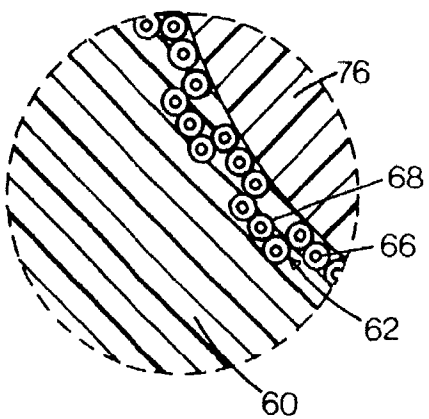

FIG. 6 shows a sheath manufacturing facility 70 including a shield braiding or weaving machine 72 and an extruder 74. A nylon core tube 76 with a smooth exterior surface with a diameter of 0.250 inch has a bore diameter of 0.200 inch. The core tube may be of any of a wide range of alternative materials, and may have a solid core. The tube is fed into the braiding machine, which wraps fine conductive metal strands 80 about the tube to form the shield 62. Thus wrapped, the shielded core is fed into the extruder 74, which extrudes the sheath 60 about the shielded core tube to form a resulting sheath component 82, which is shown in cross section in FIGS. 7A and 7B. In the preferred embodiment, the sheath material is flexible PVC, with alternative materials including thermoplastic elastomer, or polyurethane. The shield is extruded at a limited low temperature so that the sheath material maintains viscosity, does not excessively penetrate the pores or gaps between shield wires, and does not appreciably contact the core, except as minimally shown in FIG. 7B. This avoids adhesion that would make core tube extraction difficult. The sheath material partly encapsulates some of the shield wires, by at least partly encompassing them, and in selected embodiments, penetrating through interstices between the wires to contact or approach the surface of the core.

Nonetheless, the sheath material at least partly encapsulates the shield wires, generating adhesion that helps to maintain the shield and sheath interior in contact with each other throughout the length, without detaching during manufacture, assembly, or use of the cable. Consequently, the shield wires do not fall away from the sheath, but remain adhered along the entire length. This provides elastic resistance to tension, and facilitates restoration of its original length when tension is removed. The shield wires provide an elongation limit as they fully compress about the wires within to resist increasing tension, after which the elasticity of the sheath returns the shield to its original length and diameter about the wires within to provide the desired flexibility as discussed above. In some applications, these functions and benefits may be achieved if the shield detaches from the sheath, as long as the sheath is loose with respect to the cable wires, and remains attached to the sheath at each end.

Figure 8:
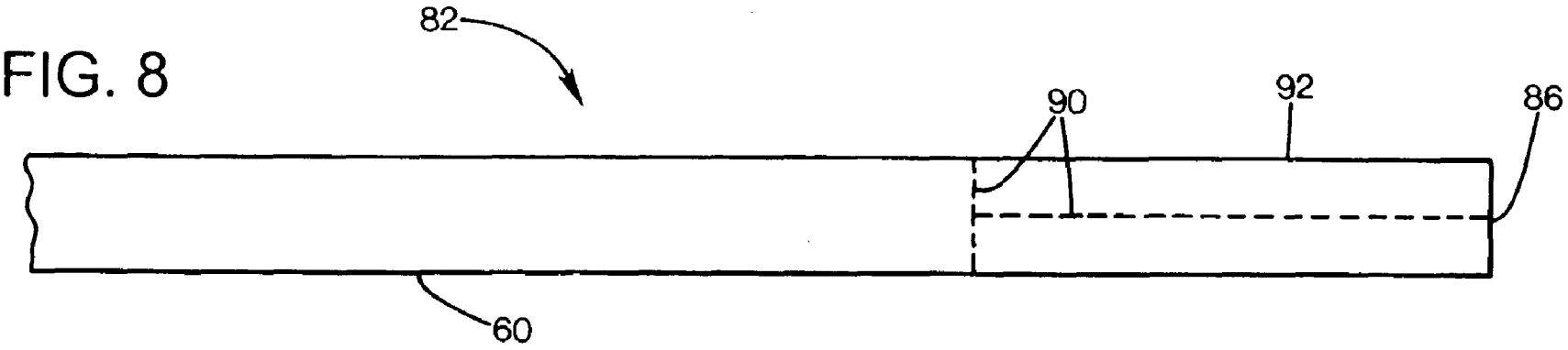
FIG. 8 is a side view of a cable assembly in a selected stage of manufacturing according to the method of FIG. 6.

FIG. 8 shows the sheath segment 82 (which includes the core, shield, and sheath) cut to provide an end 86. An opposed end (not shown) is similarly cut. The sheath layer is cut on lines 90 for removal of an end portion 92 comprising about 6 inches of the segment on each end, while leaving the shield wires and core intact.

Figure 9:
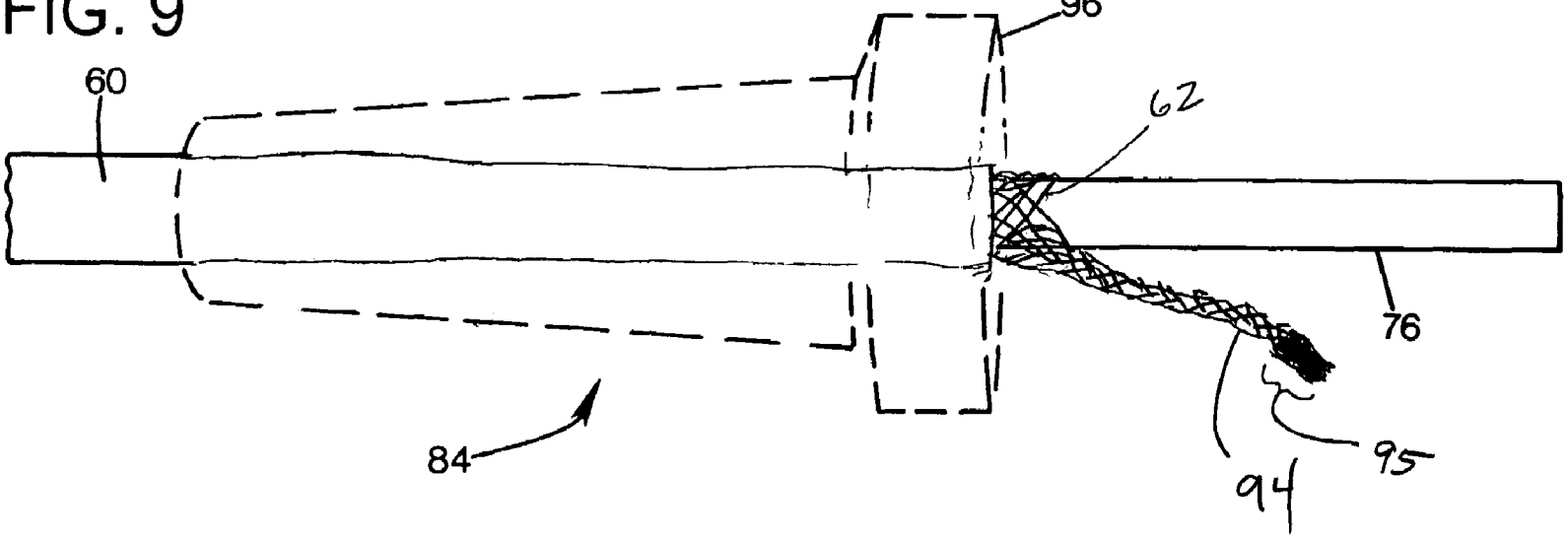
FIG. 9 is a side view of a cable assembly in a selected stage of manufacturing according to the method of FIG. 6.

As shown in FIG. 9, the end portion is removed, and the shield wires 62 are gathered into a pigtail 94. At this stage, at least the tip 95 of the pigtail is dipped in a solder bath to melt or vaporize away some or all of the insulation of the braid wires, to expose the end portions of the braid wires and to electrically connect them together.

Because the insulation material is selected for its strength, wear, and lubricity characteristics, it is from a group of materials with an effective melting point above that of a typical solder bath, which has a temperature in the range of 400-600° F. By effective melting point, this disclosure intends to refer not necessarily to the precise temperature at which a solid-to-liquid phase change is said to occur, but instead simply to a temperature at which the coating effectively melts, dissolves, burns away, vaporizes, or otherwise allows the braid wire ends to become exposed and accessible for soldering. Some residual insulation material in the solder joint does not impair a good connection that includes all braid wires, and the insulation is still considered to have been effectively melted. In the preferred embodiment, a solder bath temperature of 700° F. is employed.

In the standard solder temperature range under 600° F., suitable insulation materials do not effectively melt. There are other insulation materials that are formulated for melting away at such temperatures, but these are not suitably durable nor lubricious for the usage in the preferred embodiment. Such unsuitable low-temperature insulation materials include, for example, urethane-based coatings such as Nyleze® from Phelps-Dodge of Trenton, Ga. These are prone to nicking, which would expose the braid wire. Moreover, such materials do not lubriciously pass through the machines used for braiding the shield, and would be damaged by this process, or be unbraidable.

With the tip of the pigtail soldered, the rest of the pigtail remains flexible. This allows it to be flattened and readily captured by the cup and cone elements of the strain relief disclosed above. The tip extends from the strain relief 96 as the bundle protrudes from the center of the strain relief in a conventional manner. This allows the pigtail tip to be soldered (at conventional temperatures) or crimped for an electrical connection to ground circuitry in the instrument and the transducer wand, or whatever elements are being connected by the cable.

In an alternative embodiment, the shield ends may be stripped by mechanical means such as scraping with a blade, abrading with an abrasive sand-type blast, by a swaging process that exposes the wires, or by a connection that bites through the insulation to make contact.

Such methods are employed in an alternative embodiment in which the braided shield is simply folded back and crimped with a metallic ring encircling the cable end and connected to the exposed braid wires and grounded to a ground connection.

While the above is discussed in terms of preferred and alternative embodiments, the invention is not intended to be so limited. For instance, the cable need not employ a loose shield to enjoy the benefits of insulated shield wires, where flexibility is not needed (such as internal to an instrument). The cable may be employed in any application; the medical ultrasound application illustrated is an example. The cable bundle need not employ ribbonized components.

The invention claimed is:

1. A cable assembly comprising:

a plurality of electrically independent wires, each having a first end and opposed second end;

each of the wires having an insulating coating separating it from the other wires;

a sheath including a shield encompassing all the wires;

the shield being a braid formed of a plurality of braid wires;

each of the braid wires having an insulating coating separating it from each of die other braid wires;

the wires having intermediate portions between the first and second ends, and the intermediate portions are detached from each other; and wherein the wires are received within the shield in a loose manner, wherein the wires are loose with respect to each other.

2. The assembly of claim 1 wherein the first ends of the wires are secured to each other in a first sequential arrangement, the second ends of the wires are secured to each other in a second sequential arrangement based on the first arrangement.

3. The assembly of claim 1 wherein the insulating coating of each of the braid wires is formed of a material selected from a set of materials including thermoset resins and thermoplastics.

4. The assembly of claim 1 wherein the insulating coating of each of the braid wires has an effective melting point above 600° F.

5. The assembly of claim 1 wherein the insulating coating is formed of a thermoset resin.

6. The assembly of claim 1 wherein the wires are contained directly by the shield, such that at least some of the wires directly contact the shield.

7. A cable assembly comprising:

a plurality of electrically independent wires, each having a first end and an opposed second end;

each of the wires having an insulating coating separating it from the other wires;

a sheath including a shield encompassing all the wires;

the shield being a braid formed of a plurality of braid wires;

each of the braid wires having an insulating coating; and wherein at least one end of the shield is a pigtail formed by a close gathering of the braid wires at the one end.

8. The assembly of claim 7 wherein the pigtail includes a solder junction to each of the braid wires.

9. The assembly of claim 7 wherein the insulating coating is absent from the portions of the braid wires comprising the pigtail.

10. The assembly of claim 7 wherein the insulating coating has an effective melting point above 600° F.

11. A cable assembly comprising:

a plurality of wires, each having a first end and an opposed second end;

the first ends of the wires being secured to each other in a first sequential arrangement;

the second ends of the wires being secured to each other in a second sequential arrangement based on the first arrangement;

the wires having intermediate portions between the first and second ends, the intermediate portions being detached from each other;

a sheath including an inner shield loosely encompassing all the wires;

the inner shield being a braid formed of a plurality of braid wires; and each of the braid wires having an insulating coating.

12. A cable assembly comprising:

a plurality of electrically independent wires, each having a first end and an opposed second end;

each of the wires having an insulating coating separating it from the other wires;

a sheath including a shield encompassing all the wires;

the shield being a braid formed of a plurality of braid wires;

each of the braid wires being individually coated with an insulating coating; and wherein the wires are received within the shield in a loose manner, wherein the wires are loose with respect to each other.

13. The assembly of claim 12 wherein the first ends of the wires are secured to each other in a first sequential arrangement, the second ends of the wires are secured to each other in a second sequential arrangement based on the first arrangement.

14. The assembly of claim 12 wherein the wires having intermediate portions between the first and second ends, and the intermediate portions are detached from each other.

15. The assembly of claim 12 wherein the insulating coating is formed of a material selected from a set of materials including thermoset resins and thermoplastics.

16. The assembly of claim 12 wherein the insulating coating has an effective melting point above 600° F.

17. A cable assembly comprising:

a plurality of electrically independent wires, each having a first end and an opposed second end;

each of the wires having an insulating coating separating it from the other wires;

a sheath including a shield encompassing all the wires;

the shield being a braid formed of a plurality of braid wires;

each of the braid wires being individually coated with an insulating coating; and wherein at least one end of the shield is a pigtail formed by a close gathering of the braid wires at the one end.

18. The assembly of claim 17 wherein the insulating coating is absent from the portions of the braid wires comprising the pigtail.

19. The assembly of claim 17 wherein the insulating coating has an effective melting point above 600° F.

* * * * *